US011804202B2

(12) United States Patent
Kashiwase et al.

(10) Patent No.: US 11,804,202 B2
(45) Date of Patent: Oct. 31, 2023

(54) ELECTRONIC WIND INSTRUMENT

(71) Applicant: Yamaha Corporation, Hamamatsu (JP)

(72) Inventors: Kazuki Kashiwase, Tokyo (JP); Ryo Tabata, Hamamatsu (JP); Hiroshi Miyazaki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 349 days.

(21) Appl. No.: 17/185,322

(22) Filed: Feb. 25, 2021

(65) Prior Publication Data

US 2021/0272544 A1 Sep. 2, 2021

(30) Foreign Application Priority Data

Mar. 2, 2020 (JP) ..... 2020-034814

(51) Int. Cl.
*G10H 1/055* (2006.01)

(52) U.S. Cl.
CPC ..... *G10H 1/055* (2013.01); *G10H 2220/361* (2013.01)

(58) Field of Classification Search
CPC .. G10H 1/055; G10H 2220/361; G10H 1/047; G10H 2220/461; G10H 2230/155; G10H 2230/221; G10H 1/32; G10H 1/34; H04R 1/2826
See application file for complete search history.

(56) References Cited

U.S. PATENT DOCUMENTS 4,915,008 A 4/1990 Sakashita
5,125,315 A 6/1992 Kawashima
10,199,023 B2 * 2/2019 Pouillard ..... G10H 1/053
10,360,884 B2 * 7/2019 Okuda ..... G10H 1/0066
2005/0217464 A1 * 10/2005 Onozawa ..... G10H 1/34 84/723
2016/0275930 A1 * 9/2016 Harada ..... G10H 1/32
2018/0137846 A1 * 5/2018 Pouillard ..... G10H 1/32
2019/0096374 A1 * 3/2019 Harada ..... G10H 1/0551
2021/0312896 A1 * 10/2021 Sato ..... G10H 1/32

FOREIGN PATENT DOCUMENTS

CN 103810989 A 5/2014
JP 2013-164542 A 8/2013
JP 2017-62327 A 3/2017

OTHER PUBLICATIONS

Extended European Search Report issued in European Application No. 21159410.6 dated Jun. 18, 2021 (eight (8) pages).
Chinese-language Office Action issued in Chinese Application No. 202110225830.4 dated Jun. 1, 2023 with English translation (21 pages).

* cited by examiner

*Primary Examiner* — Jeffrey Donels
(74) *Attorney, Agent, or Firm* — Crowell & Moring LLP

(57) ABSTRACT

An electronic wind instrument includes a breath sensor, an operating element, a speaker, and an acoustic tube. The operating element receives an instruction related to a pitch. The speaker outputs a sound based on musical performance information obtained from at least one of the breath sensor and the operating element. The speaker has an inner space therein. The acoustic tube that has an inner space therein. The inner space of the acoustic tube is continuous with the inner space of the speaker. The acoustic tube extends in a direction away from the speaker.

9 Claims, 4 Drawing Sheets

ELECTRONIC WIND INSTRUMENT

CROSS-REFERENCE TO RELATED APPLICATIONS

Priority is claimed on Japanese Patent Application No. 2020-034814, filed Mar. 2, 2020, the contents of which are incorporated herein by reference.

BACKGROUND

Field of the Invention

The present disclosure relates to an electronic wind instrument.

Description of Related Art

An electronic wind instrument outputs sound from a speaker by breath blown thereinto, and has a speaker installed in a portion that imitates the bell of an alto saxophone.

SUMMARY

However, in an acoustic wind instrument such as a saxophone, sound is radiated not only from the bell but also from parts such as open tone holes, which are distanced from the bell. That is to say, the sound of an acoustic wind instrument is radiated to the outside from several different parts. For this reason, there is a problem that the acoustic characteristics of electronic wind instruments differ significantly from those of an acoustic wind instrument.

The present disclosure takes into consideration the above circumstances. An object of the present disclosure is to provide an electronic wind instrument the acoustic characteristics of which can be made to approximate to those of an acoustic wind instrument.

According to an aspect of the present disclosure, an electronic wind instrument includes: a breath sensor; an operating element that receives an instruction related to a pitch; a speaker that outputs a sound based on musical performance information obtained from at least one of the breath sensor and the operating element, the speaker having an inner space therein; and an acoustic tube that has an inner space therein, the inner space of the acoustic tube being continuous with the inner space of the speaker, the acoustic tube extending in a direction away from the speaker. Other objects, advantages and novel features of the present disclosure will become apparent from the following detailed description of one or more preferred embodiments when considered in conjunction with the accompanying drawings, in which:

DETAILED DESCRIPTION

Hereinafter, an embodiment will be described, with reference to FIG. 1 and FIG. 2.

Figure 1:
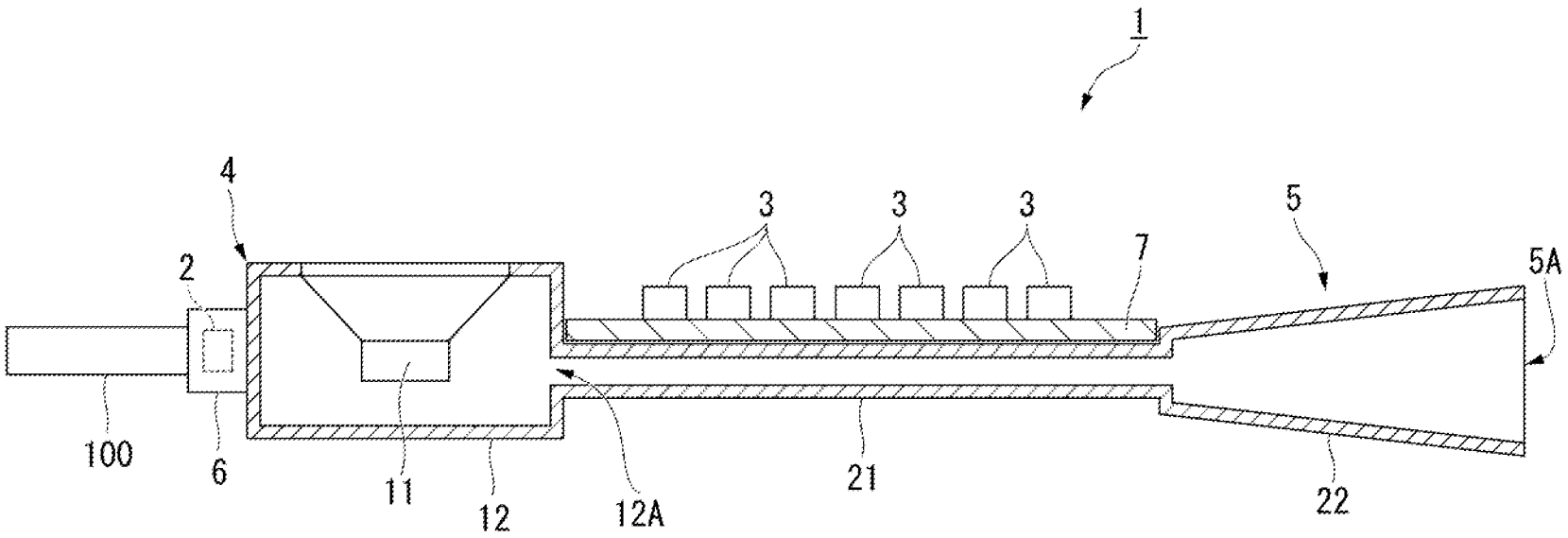
FIG. 1 is a schematic diagram showing an electronic wind instrument.

As shown in FIG. 1, an electronic wind instrument 1 includes a breath sensor 2, operating elements 3, a speaker 4, and an acoustic tube 5. The electronic wind instrument 1 further includes a mouthpiece fixing part 6 that fixes a mouthpiece 100. The mouthpiece 100 is a component for the player of the electronic wind instrument 1 to blow breath air toward the breath sensor 2.

The operating elements 3 are operated by fingers of the player to instruct at least the pitch of the sound output from the speaker 4 described later. The operating elements 3 may each be configured only with, for example, a push button to be pressed by a finger of the player, or may be of a configuration including, for example, a push button and a key mechanism for pressing a push button by being operated by a finger. Several of the operating elements 3 are provided on a same base part 7. The base part 7 may include a circuit board on which the push buttons of the operating elements 3 are mounted, and a supporting part that supports the key mechanisms of the operating elements 3.

Figure 2:
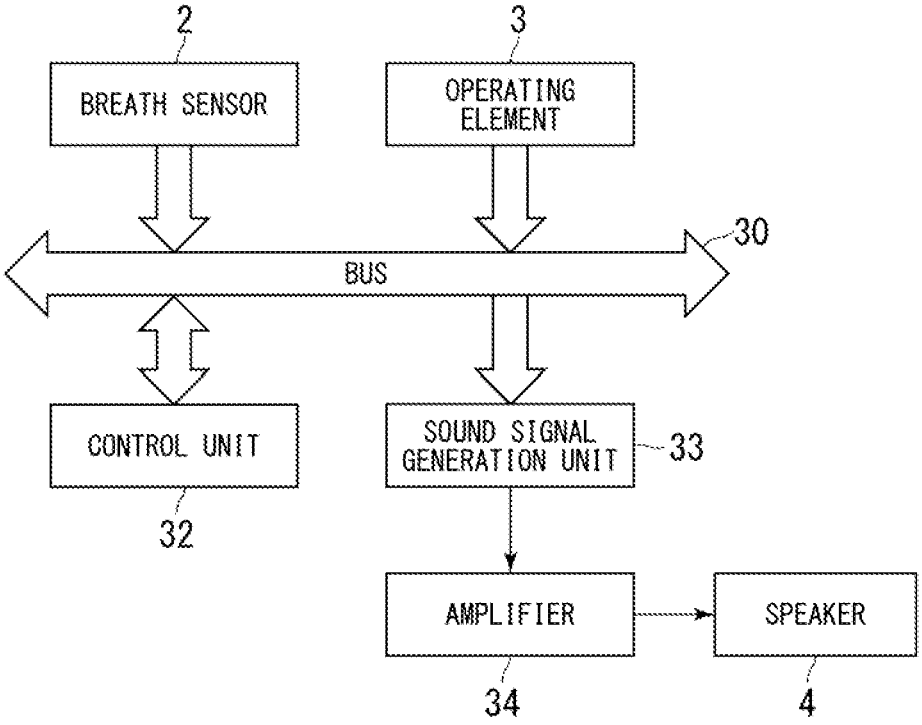
FIG. 2 is a function block diagram showing a circuit configuration of the electronic wind instrument.

As shown in FIG. 2, the electronic wind instrument 1 has a circuit in which the breath sensor 2, the operating elements 3, a control unit 32, and a sound signal generation unit 33 are connected to a bus 30.

The breath sensor 2 detects the flow velocity and duration of a breath of the player blown at the breath sensor 2, and outputs breath data according to the flow velocity and the duration of the breath. The operating elements 3 detect operations performed thereon by the player and output fingering data according to the results of the detection. The control unit 32 controls the operation of the sound signal generation unit 33 on the basis of musical performance information which includes breath data from the breath sensor 2 and fingering data from the operating elements 3. The sound signal generation unit 33, under control of the control unit 32, generates a musical sound signal including a pitch and a sound volume according to musical performance information, and outputs the musical sound signal to an amplifier 34. The musical sound signal that has been output from the sound signal generation unit 33 is amplified by the amplifier 34 and then output to the speaker 4.

The speaker 4 outputs a sound on the basis of musical performance information obtained from the breath sensor 2 and/or the operating elements 3. That is to say, the speaker 4 outputs a sound on the basis of a musical sound signal in accordance with musical performance information which has been amplified by the amplifier 34.

Specifically, the speaker 4 outputs sound when a breath of the player is blown into the mouthpiece 100. The speaker 4 may also output sound when the player operates the operating elements 3 even in the state where, for example, the player is not blowing a breath into the mouthpiece 100.

As shown in FIG. 1, the speaker 4 includes a speaker driver 11 and a speaker box 12. The speaker driver 11 generates sound on the basis of musical performance information. The speaker box 12 has a space therein and is formed in a box shape for accommodating the speaker driver 11. The speaker box 12 has an opening part (opening) 12A which connects the space inside the speaker box 12 to the outside.

The acoustic tube 5 (that is, the inner space of the acoustic tube 5) communicates to the space inside the speaker 4. That is, the inner space of the acoustic tube 5 is continuous with (communicates to) the inner space of the speaker 4. The acoustic tube 5 extends to the outside of the speaker 4. Specifically, one end of the acoustic tube 5 in the lengthwise direction is connected to the opening part 12A of the speaker box 12, and extends to the outside of the speaker box 12. The acoustic tube 5 extends linearly. The acoustic tube 5 may be curved, for example.

The acoustic tube 5 includes a first tube part 21 and a second tube part 22. The first tube part 21 extends outward from the opening part 12A (the speaker 4) of the speaker box 12. The second tube part 22 is connected to the distal end of the first tube part 21 in the extending direction. The second tube part 22 includes an opening end 5A of the acoustic tube 5 which opens outward.

The first tube part 21 is a tube in the extending direction of which the diameter dimension of the first tube part 21 does not change or the change in the diameter dimension is small. On the other hand, the second tube part 22 is a tapered tube and the diameter dimension thereof increases as the distance from the distal end of the first tube part 21 increases. That is to say, the second tube part 22 is formed in a shape corresponding to the bell of an acoustic wind instrument.

The first tube part 21 is not limited to being a tube having the shape mentioned above, and may be, for example, a tapered tube similar to the second tube part 22, or a tube in which the change in the diameter dimension of the first tube part 21 is large in the extending direction thereof.

The second tube part 22 is made of a metal. The second tube part 22 may be configured with a material other than metal, such as a resin. The first tube part 21 may be made of metal. The first tube part 21 may be made of the same metal as that of the second tube part 22. The first tube part 21 may be configured with a material different from that of the second tube part 22 (for example, a material other than metal such as a resin).

The first tube part 21 and the second tube part 22 may be integrally formed, for example. Alternatively, the first tube part 21 and the second tube part 22 may be formed separately and then coupled to each other, for example.

The operating elements 3 described above are provided on the acoustic tube 5. Specifically, the operating elements 3 are provided on the first tube part 21 of the acoustic tube 5. The plurality of operating elements 3 are arranged aligned with the lengthwise direction of the first tube part 21. Moreover, a base part 7 is interposed between the plurality of operating elements 3 and the first tube part 21. The base part 7 may be in contact with the outer peripheral surface of the first tube part 21, or may be arranged spaced from the outer peripheral surface of the first tube part 21. The operating elements 3 and the base part 7 are not provided on the second tube part 22. That is to say, the second tube part 22 is not covered by the operating elements 3 or the base part 7, and (the outer surface of) the second tube part 22 is exposed entirely.

The mouthpiece fixing part 6 is fixed to the speaker 4. Specifically, the mouthpiece fixing part 6 is fixed directly to the speaker box 12. The mouthpiece fixing part 6 serves to fix the mouthpiece 100. That is to say, the mouthpiece fixing part 6 serves to attach the mouthpiece 100 to the speaker box 12. The mouthpiece fixing part 6 may be configured to detachably fix the mouthpiece 100.

The breath sensor 2 is arranged inside the mouthpiece fixing part 6. Therefore, in the state where the mouthpiece 100 is fixed to the mouthpiece fixing part 6, a breath of the player blown into the mouthpiece 100 enters the interior of the mouthpiece fixing part 6 and reaches the breath sensor 2. As a result, the breath sensor 2 can detect the flow velocity and duration of the breath of the player.

The speaker 4 is positioned between the mouthpiece fixing part 6 and the operating elements 3 described above. The mouthpiece fixing part 6, the speaker 4, and the operating elements 3 are arranged in this order in a linear direction (the left-right direction in FIG. 1). Moreover, in the state where the mouthpiece 100 is fixed to the mouthpiece fixing part 6, the mouthpiece 100, the speaker 4, and the operating elements 3 are arranged in this order in the linear direction.

In the electronic wind instrument 1, the speaker driver 11 is oriented in a direction (the upward direction in FIG. 1) which is primarily (or approximately) orthogonal to the direction in which the mouthpiece fixing part 6 (the mouthpiece 100), the speaker 4, and the operating elements 3 (the acoustic tube 5) are arranged. Therefore, the sound emitted from the speaker driver 11 is radiated primarily in the direction orthogonal to the direction in which the mouthpiece fixing part 6 (the mouthpiece 100), the speaker 4, and the operating elements 3 are arranged.

In the electronic wind instrument 1, the sound emitted from the speaker 4 (speaker driver 11) on the basis of performance information obtained from the breath sensor 2 and the operating elements 3 is directly radiated from the speaker 4 (speaker driver 11) to the outside. Further, the sound emitted from the speaker 4 (that is, the sound emitted from the back side of the speaker driver 11) is radiated to the outside from the opening end 5A of the acoustic tube 5 through the space within the speaker 4 (the speaker box 12) and through the interior of the acoustic tube 5. That is to say, the sound of the speaker 4 (speaker driver 11) can be radiated to the outside of the electronic wind instrument 1 from two different positions. As a result, the acoustic characteristics of the electronic wind instrument 1 can be made to approximate to those of an acoustic wind instrument.

Further, in the electronic wind instrument 1, the direction in which the speaker driver 11 is oriented (the upward direction in FIG. 1) and the direction in which the opening end 5A of the acoustic tube 5 opens (the right direction in FIG. 1) are different from each other. Therefore, the sound of the speaker 4 (speaker driver 11) emitted from two different positions can be radiated in different directions.

The direction in which the opening end 5A of the acoustic tube 5 opens may be arbitrarily set. Thereby, the radiation direction of the sound emitted from the opening end 5A of the acoustic tube 5 can be arbitrarily set.

Moreover, in the electronic wind instrument 1, the position at which the sound is radiated (particularly, the sound radiation position with reference to the player) can be changed according to fingering (pitch), as with an acoustic wind instrument. This point will be described below.

In an acoustic wind instrument, the lower the sound, the more tone holes are closed and, consequently, the louder the sound radiated from the bell (the opening end of the acoustic tube) becomes. For this reason, in an acoustic wind instrument, the lower the sound, it sounds as if sounding at a position farther from the player (the mouthpiece).

On the other hand, in the electronic wind instrument 1, the lower the sound emitted from the speaker 4, the more likely it is to resonate in the acoustic tube 5. Therefore, in the electronic wind instrument 1, the lower the sound, the louder the sound radiated from the opening end 5A of the acoustic tube 5 becomes, as with the case of an acoustic wind instrument. Moreover, in the electronic wind instrument 1, as described above, sound is radiated from both the speaker 4 positioned in the vicinity of the player (the mouthpiece 100) and the opening end 5A of the acoustic tube 5 positioned farther from the player (the mouthpiece 100) than the speaker 4. As a result, even in the electronic wind instrument 1, as with the case of an acoustic wind instrument, the lower the sound, it sounds as if sounding at a position farther from the player (the mouthpiece 100).

Therefore, the acoustic characteristics of the electronic wind instrument 1 are similar to the acoustic characteristics of an acoustic wind instrument.

In the electronic wind instrument 1, the operating elements 3 are provided on the acoustic tube 5. Therefore, vibrations that occur as sound is emitted from the speaker 4 (the speaker driver 11) can be transmitted to the fingers of the player through the acoustic tube 5 and the operating elements 3. Such mechanism of vibration transmission is similar to that of an acoustic wind instrument, and therefore, the player can play the electronic wind instrument 1 with a feeling that resembles that of an acoustic wind instrument.

Furthermore, in the electronic wind instrument 1, the mouthpiece 100 is fixed to the mouthpiece fixing part 6, so that the mouthpiece 100 is connected to the speaker 4 (the speaker box 12). As a result, vibrations that occur as sound is emitted from the speaker 4 (the speaker driver 11) can be transmitted to the mouth of the player through the mouthpiece 100. Such mechanism of vibration transmission is similar to that of an acoustic wind instrument, and therefore, the player can play the electronic wind instrument 1 with a feeling that further resembles that of an acoustic wind instrument.

In the electronic wind instrument 1, the speaker 4 is positioned between the mouthpiece fixing part 6 (the mouthpiece 100) and the operating elements 3. As a result, vibrations that occur as sound is emitted from the speaker 4 (the speaker driver 11) can be efficiently transmitted to both the mouthpiece 100 and the operating elements 3.

Furthermore, in the electronic wind instrument 1, the operating elements 3 are provided on the first tube part 21 of the acoustic tube 5, and are not provided on the second tube part 22. Therefore, the structure of the electronic wind instrument 1 can be made to approximate to the structure of an acoustic wind instrument, which does not have tone holes or key mechanisms for opening and closing the tone holes at the distal end part (for example, the bell) of the tube body thereof. As a result, the acoustic characteristics of the electronic wind instrument 1 can be made to further approximate to those of an acoustic wind instrument.

Moreover, in the electronic wind instrument 1, the second tube part 22 of the acoustic tube 5, which is exposed and not covered by the operating elements 3, is made of a metal. By making the metal-made second tube part 22 as with the tube body of an acoustic wind instrument such as a saxophone, the acoustic characteristics of the electronic wind instrument 1 can be made to approximate to those of an acoustic wind instrument. In addition, the appearance design of the electronic wind instrument 1 can be made to approximate to that of a metal-made acoustic wind instrument.

Figure 3:
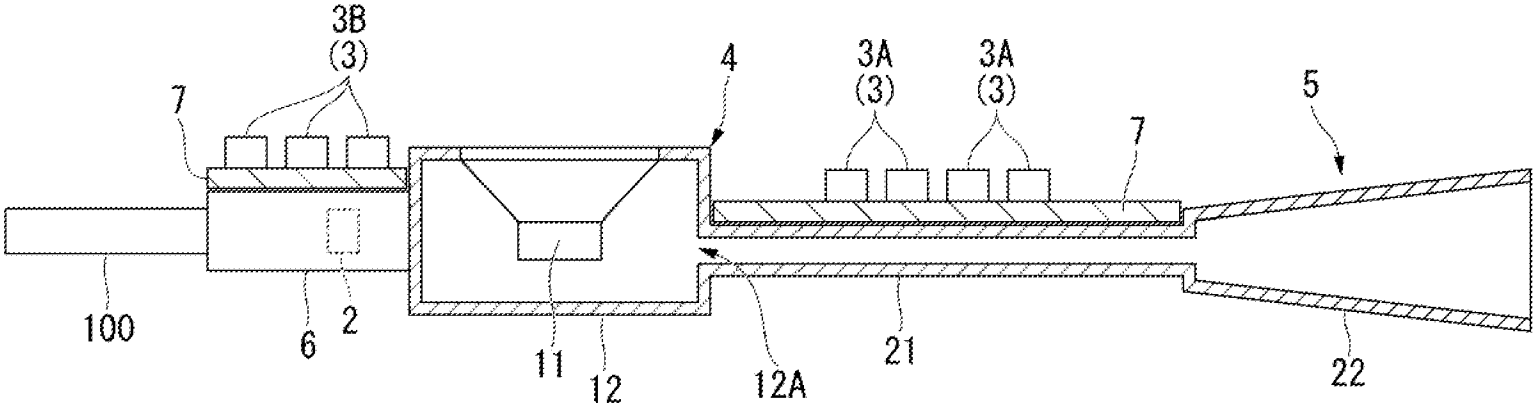
FIG. 3 is a schematic diagram showing a modified example of the electronic wind instrument of FIG. 1 and FIG. 2.

In the electronic wind instrument 1, for example, as shown in FIG. 3, at least one operating element 3A of the plurality of operating elements 3 may be arranged so that the speaker 4 is positioned between the at least one operating element 3A and the mouthpiece 100. In FIG. 3, the remaining operating elements 3B of the plurality of operating elements 3 are positioned between the mouthpiece 100 and the speaker 4 and are provided on the mouthpiece fixing part 6. However, the first embodiment is not limited to this example.

Figure 4:
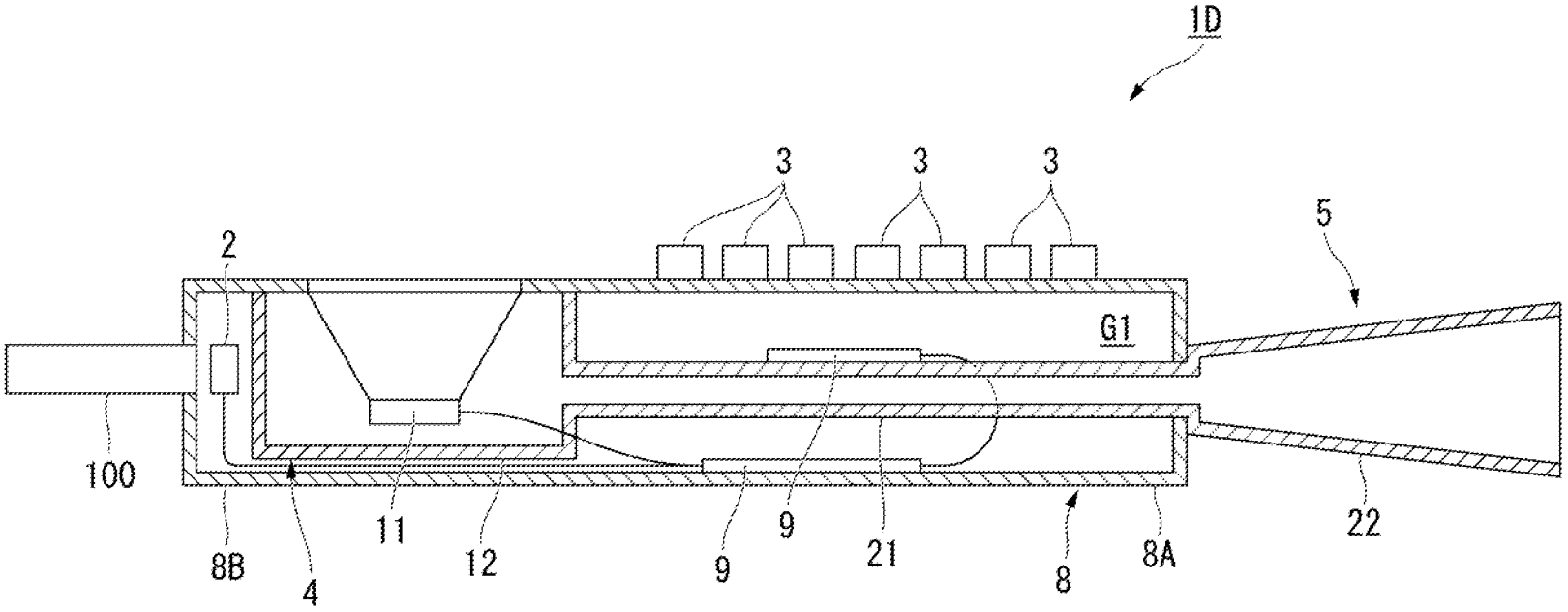
FIG. 4 is a schematic diagram showing an electronic wind instrument.

As shown in FIG. 4, an electronic wind instrument 1D includes a breath sensor 2, operating elements 3, a speaker 4, and an acoustic tube 5. The electronic wind instrument 1D further includes a casing 8 and circuit boards 9.

The casing 8 surrounds the outside of the acoustic tube 5 so as to be spaced from an outer peripheral surface of the acoustic tube 5. The casing 8 is formed in a tubular shape extending in the lengthwise direction of the acoustic tube 5. Inside the casing 8, the speaker 4 is arranged in addition to a first tube part 21 of the acoustic tube 5. A second tube part 22 of the acoustic tube 5 projects outward of the case 8 from a first end part 8A in the axial direction of the casing 8. In the state where the first tube part 21 and the speaker 4 are arranged inside the casing 8, a clearance G1 is present between the outer peripheral surface of the first tube part 21 and the inner peripheral surface of the casing 8.

The speaker 4 arranged inside the casing 8 is positioned at a second end part 8B in the axial direction of the casing 8. The speaker box 12 is fixed to the casing 8. Specifically, the speaker box 12 is fixed to a part in the circumferential direction of a peripheral wall part of the casing 8 forming the second end part 8B, and is positioned at a distance from the remaining portion in the circumferential direction of the peripheral wall part. In the example shown in FIG. 4, a part of the speaker box 12 is integrally formed with the peripheral wall part of the casing 8, however, the disclosure is not limited to this example.

The mouthpiece 100 is fixed to the second end part 8B of the casing 8. A portion of the second end part 8B of the casing 8 between the speaker 4 and the mouthpiece 100 corresponds to the mouthpiece fixing part 6 (see FIG. 1) previously discussed. The breath sensor 2 is arranged inside the second end part 8B of the casing 8. Therefore, in the state where the mouthpiece 100 is fixed to the second end part 8B of the casing 8, a breath of the player blown into the mouthpiece 100 enters the interior of the second end part 8B of the casing 8 and reaches the breath sensor 2. As a result, the breath sensor 2 can detect the flow velocity and duration of the breath of the player.

The first end part 8A of the casing 8 is closed except for the portion through which the acoustic tube 5 penetrates. Also, the second end part 8B of the casing 8 is closed except for the portion to which the mouthpiece 100 is attached. Therefore, the clearance G1 between the outer peripheral surface of the first tube part 21 and the inner peripheral surface of the casing 8 does not communicate to the outside through the first end part 8A and the second end part 8B of the casing 8 except for the mouthpiece 100.

The operating elements 3 are provided on the outer peripheral surface of the casing 8. Specifically, the operating elements 3 are provided on the outer peripheral surface of a portion of the peripheral wall part of the casing 8 that covers the first tube part 21. The plurality of operating elements 3 are arranged aligned with the axial direction of the casing 8 (the lengthwise direction of the first tube part 21). Therefore, the portion of the peripheral wall part of the casing 8 where the operating elements 3 are provided corresponds to the base part 7 previously discussed.

The circuit boards 9 have a function of outputting musical sound signals to the speaker 4 on the basis of musical performance information from the breath sensor 2 and/or the operating elements 3. That is to say, the circuit boards 9 include a control unit 32, a sound signal generation unit 33, a bus 30, an amplifier 34, and so forth as previously discussed (see FIG. 2). The circuit boards 9 are connected to the breath sensor 2, the operating elements 3, and the speaker 4. The number of the circuit boards 9 may be one, for example. However, the circuit boards 9 are separated into a plurality of (two in the example shown in FIG. 3) circuit boards. The plurality of circuit boards 9 are connected to each other. In the example shown in FIG. 4, the same (single) circuit board 9 is connected to the breath sensor 2 and the speaker 4. However, the disclosure is not limited to this example. The same (single) circuit board 9 may be connected to at least one of the breath sensor 2, the operating elements 3, and the speaker 4.

The circuit boards 9 are provided in the clearance G1 between the outer peripheral surface of the first tube part 21 and the casing 8. The plurality of circuit boards 9 are fixed, by means of screwing fastening or the like, to both the outer peripheral surface of the first tube part 21 and the inner peripheral surface of the casing 8. The circuit boards 9 may be fixed to only one of the outer peripheral surface of the first tube part 21 and the inner peripheral surface of the casing 8, for example. Moreover, the circuit boards 9 are not limited to being provided only in the clearance G1 between the outer peripheral surface of the first tube part 21 and the inner peripheral surface of the casing 8, and may also be provided between the speaker 4 and the inner peripheral surface of the casing 8, for example.

According to the electronic wind instrument 1D, advantageous effects similar to those discussed earlier can be achieved.

Moreover, the casing 8 is arranged so as to be spaced from the outer peripheral surface of the acoustic tube 5. As a result, even if the operating elements 3 are provided on the outer peripheral surface of the casing 8, it is still possible to prevent the operating elements 3 from interfering with the acoustic tube 5. For example, even if a part of an operating element 3 moves to approach from the casing 8 to the acoustic tube 5 as the player operates the operating element 3, that part is prevented from reaching the outer peripheral surface of the acoustic tube 5, thereby suppressing or preventing it from coming in contact with the acoustic tube 5.

Furthermore, the circuit boards 9 are provided in the clearance G1 between the outer peripheral surface of the acoustic tube 5 and the casing 8. Therefore, miniaturization of the electronic wind instrument 1D can be achieved without the acoustic tube 5 being affected.

In the electronic wind instrument 1D, for example, some (for example, one) of the plurality of operating elements 3 may be arranged in a portion of the casing 8 between the speaker 4 and the mouthpiece 100.

The several embodiments of the present disclosure has been described in detail above, however, the present disclosure is not limited to the above embodiments, and various modifications may be made without departing from the scope of the present disclosure.

In some embodiments of the present disclosure, the mouthpiece 100 may be integrally provided with, for example, the speaker 4 (the speaker box 12 in particular). That is to say, the mouthpiece 100 may be provided undetachable from the speaker 4.

In some embodiments of the present disclosure, the breath sensor 2 is not limited to being arranged inside the mouthpiece fixing part 6 or inside a part of the casing 8 corresponding to the mouthpiece fixing part 6, and the breath sensor 2 may be arranged, for example, outside the mouthpiece fixing part 6 or outside the casing 8.

According to some embodiments of the present disclosure, the acoustic characteristics of an electronic wind instrument can be made to approximate to those of an acoustic wind instrument.

What is claimed is:

1. An electronic wind instrument comprising:

a breath sensor;

an operating element that receives an instruction related to a pitch;

a speaker that outputs a sound based on musical performance information obtained from at least one of the breath sensor and the operating element, the speaker having an inner space therein; and an acoustic tube that has an inner space therein, the inner space of the acoustic tube being continuous with the inner space of the speaker, the acoustic tube extending in a direction away from the speaker, wherein the sound based on the musical performance information is directly radiated to an outside of the speaker and is radiated to an outside of the electronic wind instrument from an opening end of the acoustic tube through an inner space of the acoustic tube.

2. The electronic wind instrument according to claim 1, wherein the operating element is provided on the acoustic tube.

3. The electronic wind instrument according to claim 1, wherein the acoustic tube includes:

a first tube part that includes a first end connected to the speaker and a second end spaced apart from the first end; and a second tube part connected to the second end of the first tube part, wherein the operating element is provided on the first tube part.

4. The electronic wind instrument according to claim 3, wherein the second tube part includes metal.

5. The electronic wind instrument according to claim 1, further comprising: a mouthpiece fixing part configured to fix a mouthpiece, wherein the mouthpiece fixing part is fixed to the speaker.

6. The electronic wind instrument according to claim 5, wherein the speaker is positioned between the mouthpiece fixing part and the operating element.

7. The electronic wind instrument according to claim 1, further comprising: a casing that surrounds an outer peripheral surface of the acoustic tube and is spaced from the outer peripheral surface of the acoustic tube.

8. The electronic wind instrument according to claim 7, further comprising: a circuit board that is provided in a clearance defined between the outer peripheral surface of the acoustic tube and the casing.

9. The electronic wind instrument according to claim 8, wherein the circuit board is connected to at least one of the breath sensor, the operating element, and the speaker.

* * * * *